US012687353B2

(12) United States Patent
Geissele et al.

(10) Patent No.: US 12,687,353 B2
(45) Date of Patent: Jul. 21, 2026

(54) FIREARM BOLT ASSEMBLY

(71) Applicant: WHG Properties, LLC, North Wales, PA (US)

(72) Inventors: William H. Geissele, Lower Gwynedd, PA (US); David Duhaime, Ivyland, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 173 days.

(21) Appl. No.: 18/503,893

(22) Filed: Nov. 7, 2023

(65) Prior Publication Data

US 2025/0146771 A1 May 8, 2025

(51) Int. Cl.
*F41A 3/14* (2006.01)

(52) U.S. Cl.
CPC ..... *F41A 3/14* (2013.01)

(58) Field of Classification Search
CPC ..... F41A 15/14; F41A 15/00; F41A 15/12; F41A 3/14
USPC ..... 89/132; 42/25
See application file for complete search history.

(56) References Cited

U.S. PATENT DOCUMENTS

| | | | | |
|---|---|---|---|---|
| 6,484,430 | B1 | 11/2002 | Robinson et al. | |
| 6,609,319 | B1 | 8/2003 | Olson | |
| 9,435,596 | B2 | 9/2016 | Daniel et al. | |
| 9,488,423 | B2 | 11/2016 | Sullivan et al. | |
| 2005/0066564 | A1* | 3/2005 | Keeney | F41A 3/36 42/16 |
| 2016/0178302 | A1* | 6/2016 | Daniel | F41A 3/16 29/434 |
| 2021/0364244 | A1* | 11/2021 | Kling | F41A 15/14 |

OTHER PUBLICATIONS

Metrotech Engineering, Extractor Pin Retainer Ring | Mototech Engineering [retrieved from Internet Jul. 31, 2023] https://www.mototecheng.com/product/extractor-pin-retainer-ring/ (1 page).
Extended European Search Report for EP Patent Application No. 24209224.5 dated Apr. 1, 2025 (9 pages).

* cited by examiner

*Primary Examiner* — John Cooper
(74) *Attorney, Agent, or Firm* — Alston & Bird LLP

(57) ABSTRACT

A bolt assembly that includes a bolt defining at least one bolt opening and an extractor that is configured to pivot relative to the bolt. The extractor may define at least one extractor opening. The bolt assembly may include a pin positioned within the at least one bolt opening and the at least one extractor opening. The bolt assembly may include a retainer that is positioned inward relative to an exterior surface of the bolt assembly. The retainer may be removably coupled to the pin.

20 Claims, 13 Drawing Sheets

FIREARM BOLT ASSEMBLY

TECHNICAL FIELD

The present application relates generally to a bolt assembly for a firearm. More specifically, the present application relates to a bolt assembly for a firearm that includes a pin and a retainer for retaining the pin within the bolt assembly.

BACKGROUND

Firearms, such as an M16, AR-10, or AR-15, often include a gas or piston operated rotating bolt system. Rotating bolt systems often include a bolt carrier group that may include various components, such as a bolt carrier, cam pin, firing pin, gas key, and a bolt assembly. The bolt carrier may define a cam slot for the cam pin to follow, the cam slot may define cam profiles for allowing controlled rotation and axial stroke of the bolt relative to the bolt carrier. The bolt assembly, which may be positioned at least partially within the bolt carrier group and retained in place by the cam pin, can include various components, such as a bolt and an extractor.

The inventors have identified numerous deficiencies and problems with the existing technologies in this field. Through applied effort, ingenuity, and innovation, many of these identified deficiencies and problems have been solved by developing solutions that are structured in accordance with the embodiments of the present disclosure, many examples of which are described in detail herein.

BRIEF SUMMARY

In general, embodiments of the present disclosure provided herein include apparatuses to provide for improved retainment means for retaining a pin within a bolt assembly.

In various aspects, a bolt assembly defines a longitudinal direction and a radial direction that is orthogonal to the longitudinal direction. The bolt assembly may include a bolt defining at least one bolt opening and an extractor that is configured to pivot relative to the bolt. The extractor may define at least one extractor opening. The bolt assembly may include a pin positioned within the at least one bolt opening and the at least one extractor opening. The bolt assembly may include a retainer that is positioned inward relative to an exterior surface of the bolt assembly. The retainer may be removably coupled to the pin.

In various examples, the retainer includes a circlip defining a curved portion that extends at least partially around the pin.

In various examples, the retainer has a straight portion.

In various examples, the retainer has a curved portion that is positioned away from the pin. The straight portion may be positioned directly on the pin.

In various examples, the extractor includes a slot. The straight portion of the retainer may be an arm that is positioned at least partially within the slot of the extractor.

In various examples, the arm extends thirty degrees or less relative to the longitudinal direction.

In various examples, the arm extends at a downward or upward angle that is less than ninety degrees relative to the longitudinal direction and extends generally in a forward direction.

In various examples, the arm extends at a downward or upward angle that is less than ninety degrees relative to the longitudinal direction and extends generally in an aft direction.

In various examples, the arm extends at an angle that is ninety degrees relative to the longitudinal direction.

In various examples, the arm extends parallel to the longitudinal direction.

In various examples, the retainer is configured to exert a radial force on the extractor relative to an axis defined by the pin.

In various examples, the pin defines a groove. The retainer may be at least partially positioned within the groove.

In various examples, the extractor defines a recessed portion. The retainer may be at least partially positioned within the recessed portion.

In various examples, the recessed portion defines an annular portion that has an annular shape and a bump feature that deviates from the annular shape.

In various examples, the recessed portion of the extractor defines a retainment feature configured to engage the retainer.

In various examples, the retainment feature has a cross-sectional dovetail or T-shape.

In various examples, the bolt defines a channel that extends at least partially around the at least one bolt opening. The retainer may be at least partially positioned within the channel.

In various examples, the bolt assembly includes a second retainer that is removably coupled to the pin.

In various aspects, a firearm includes a bolt assembly that defines a longitudinal direction and a radial direction that is orthogonal to the longitudinal direction. The bolt assembly of the firearm may include a bolt defining at least one bolt opening and an extractor that is configured to pivot relative to the bolt. The extractor may define at least one extractor opening. The bolt assembly of the firearm may include a pin positioned within the at least one bolt opening and the at least one extractor opening. The bolt assembly of the firearm may include a retainer that is positioned inward relative to an exterior surface of the bolt assembly. The retainer of the firearm may be removably coupled to the pin.

In various aspects, a method of assembling a bolt assembly includes positioning an extractor and a retainer within an orifice of a bolt. The method may include inserting a pin into at least one bolt opening of the bolt, into at least one extractor opening of the extractor, and through the retainer.

In various examples, the method includes positioning the retainer within a recessed portion of the extractor prior to positioning the extractor and the retainer within the orifice of the bolt.

In various examples, the method includes positioning an arm of the retainer within a slot of the extractor.

In various examples, the method includes positioning a second retainer within a channel of the bolt and inserting the pin through the second retainer.

In various aspects, a bolt assembly includes a bolt defining at least one bolt opening. The bolt assembly may include an extractor that is configured to pivot relative to the bolt. The extractor may define at least one extractor opening. The bolt assembly may include a pin positioned within the at least one bolt opening and the at least one extractor opening. The bolt assembly may include a means for retaining the pin within the bolt assembly. The means for retaining the pin may be positioned inward relative to an exterior surface of the bolt assembly.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below. Other features, aspects, and advantages of the subject matter will become apparent from the description, the drawings, and the claims.

BRIEF DESCRIPTION OF THE DRAWINGS

Figure 1:
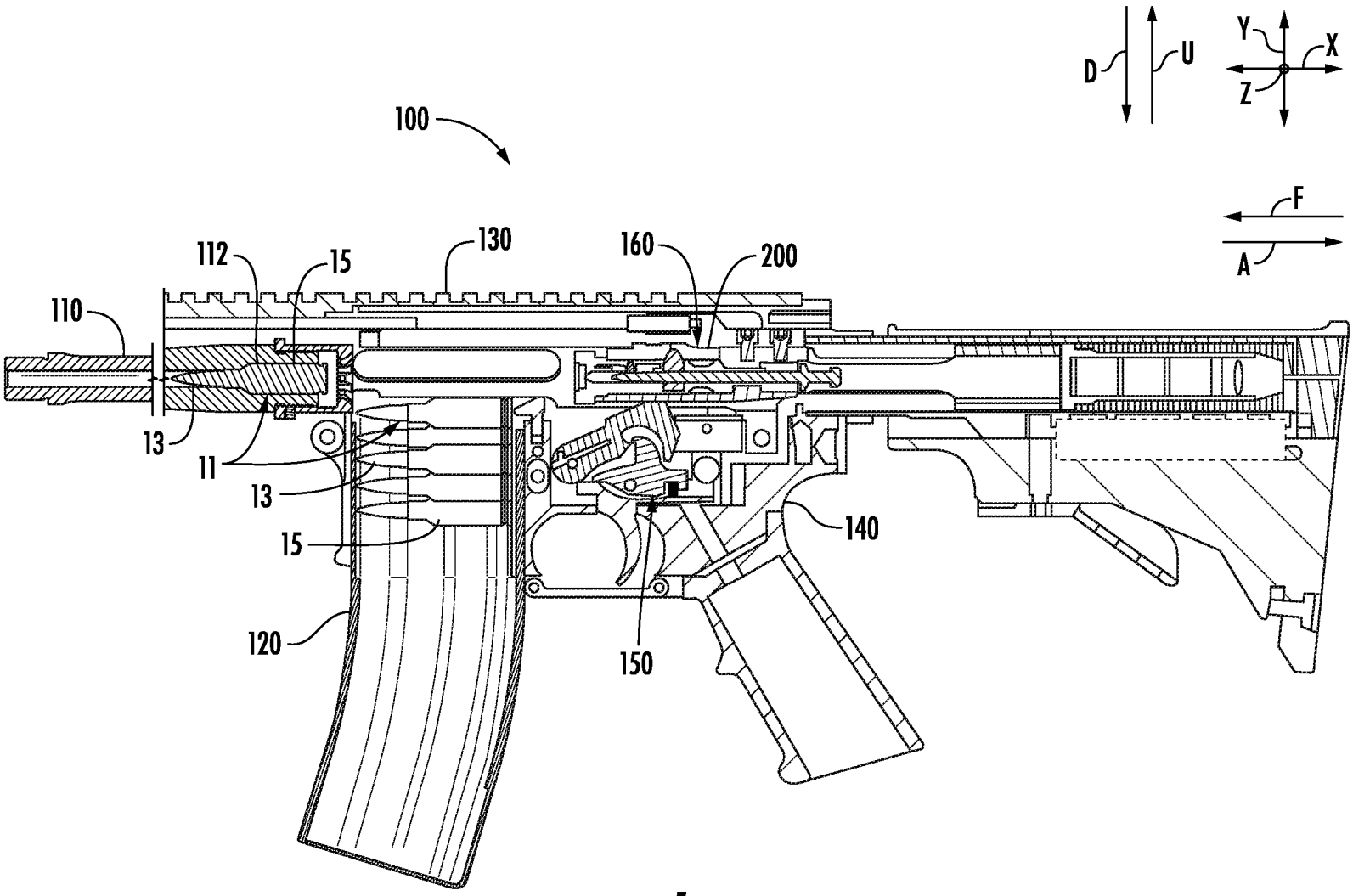

Having thus described certain example embodiments of the present disclosure in general terms above, non-limiting and non-exhaustive embodiments of the subject disclosure are described with reference to the following figures, which are not necessarily drawn to scale and wherein like reference numerals refer to like parts throughout the various views unless otherwise specified. The components illustrated in the figures may or may not be present in certain embodiments described herein. Some embodiments may include fewer (or more) components than those shown in the figures.

FIG. 1 provides a cross-sectional side view of a firearm, in accordance with an example embodiment.

Figure 2A:
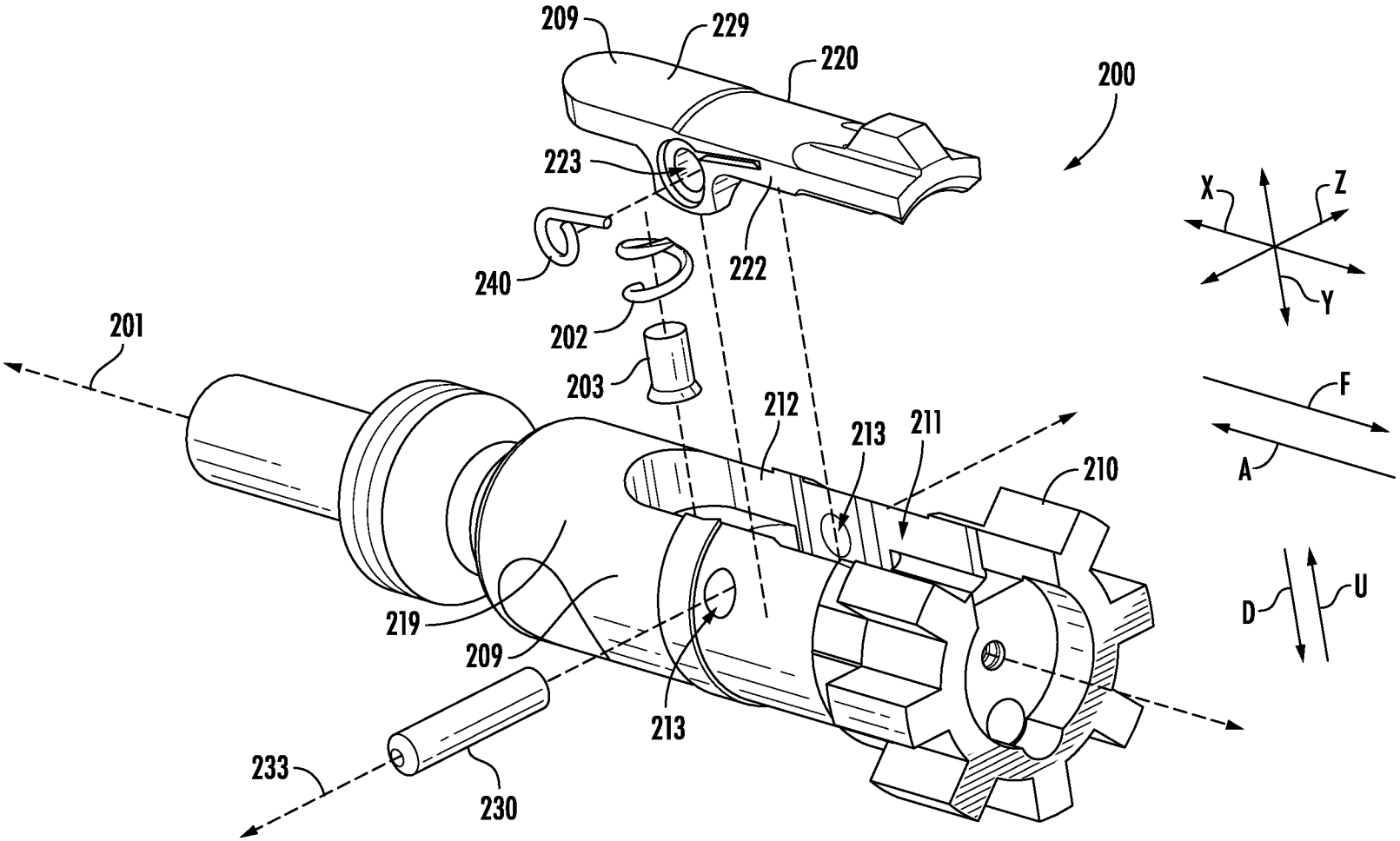

FIG. 2A provides an exploded view of a bolt assembly, in accordance with an example embodiment.

Figure 2B:
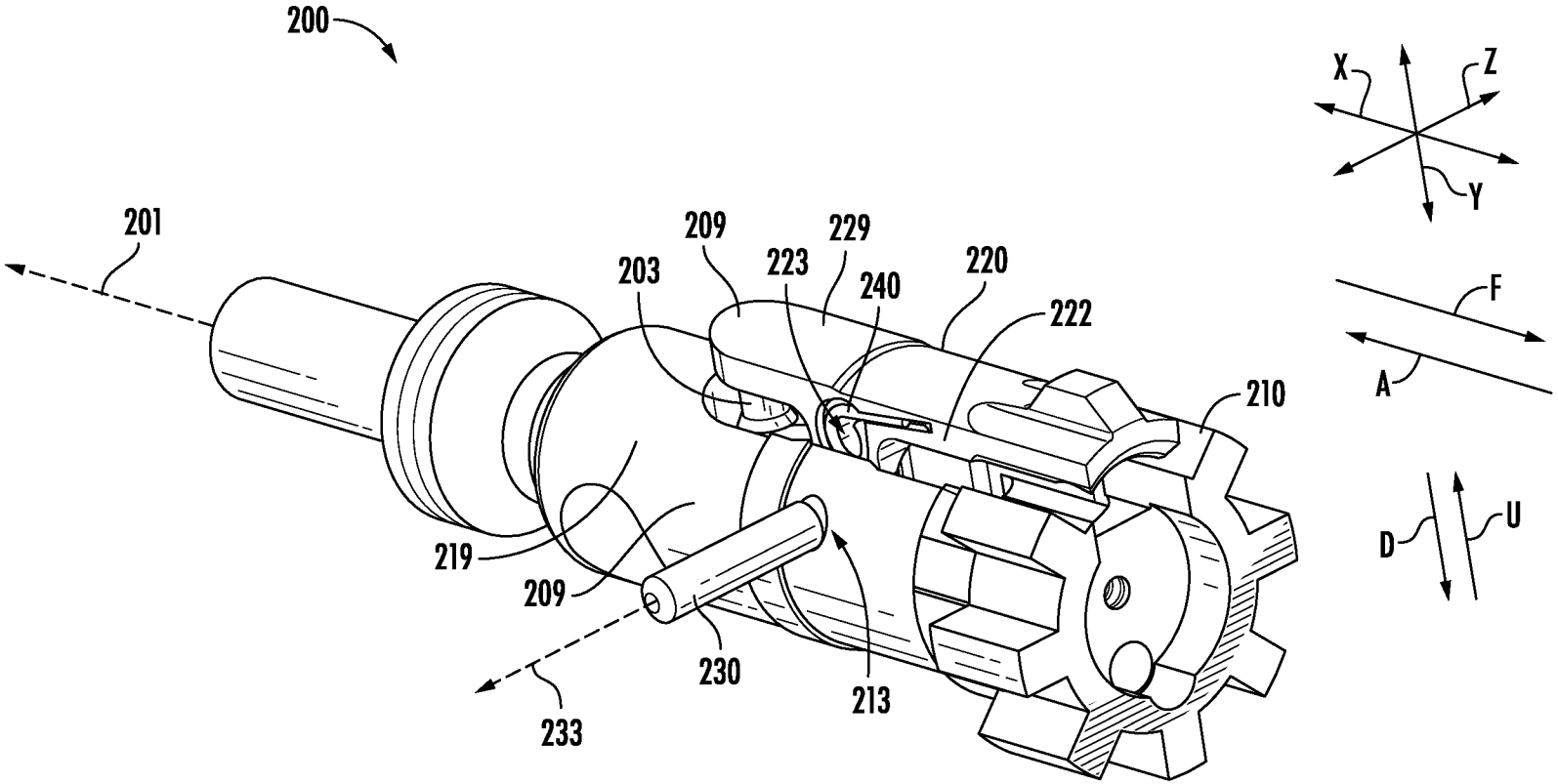

FIG. 2B provides an exploded view of the bolt assembly of FIG. 2A, in accordance with an example embodiment.

Figure 2C:
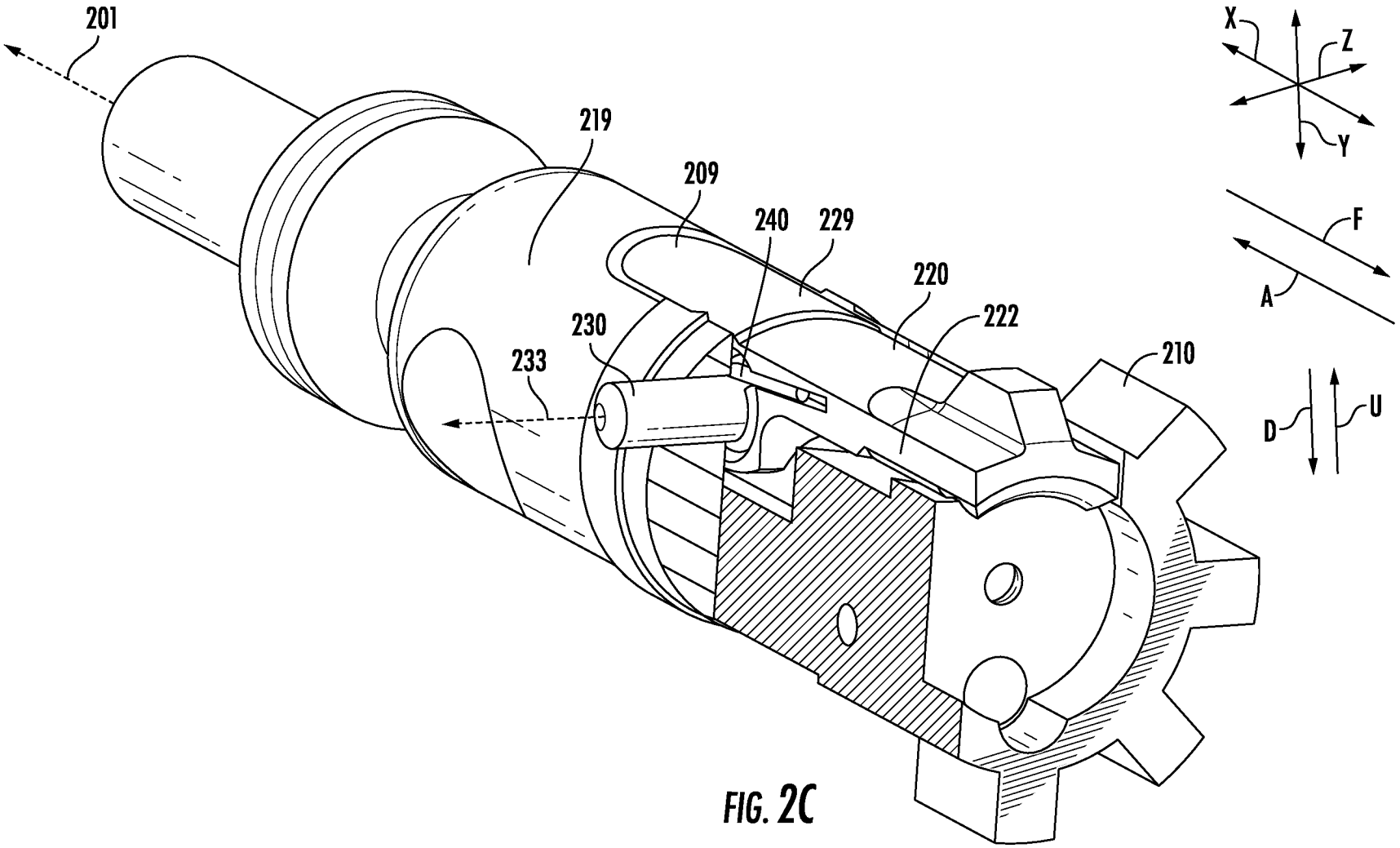

FIG. 2C provides a partial cross-sectional view of the bolt assembly of FIG. 2A, in accordance with an example embodiment.

Figure 3A:
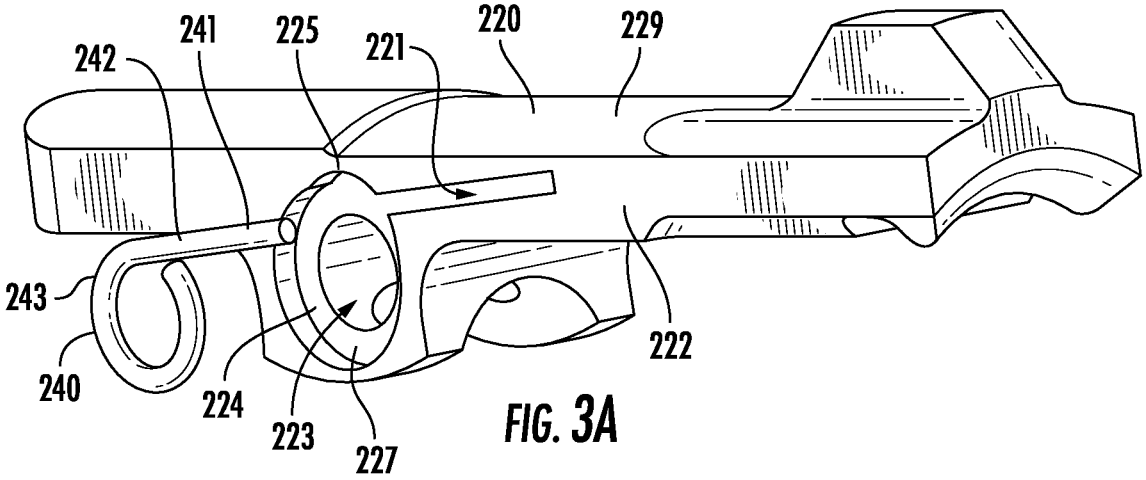

FIG. 3A provides an exploded view of an extractor and a retainer, in accordance with an example embodiment.

Figure 3B:
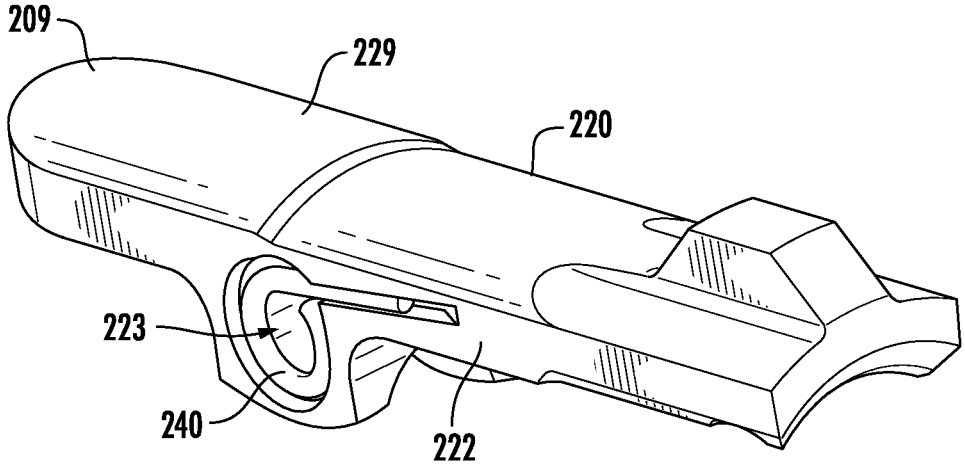

FIG. 3B provides a perspective view of the extractor and the retainer of FIG. 3A, in accordance with an example embodiment.

Figure 3C:
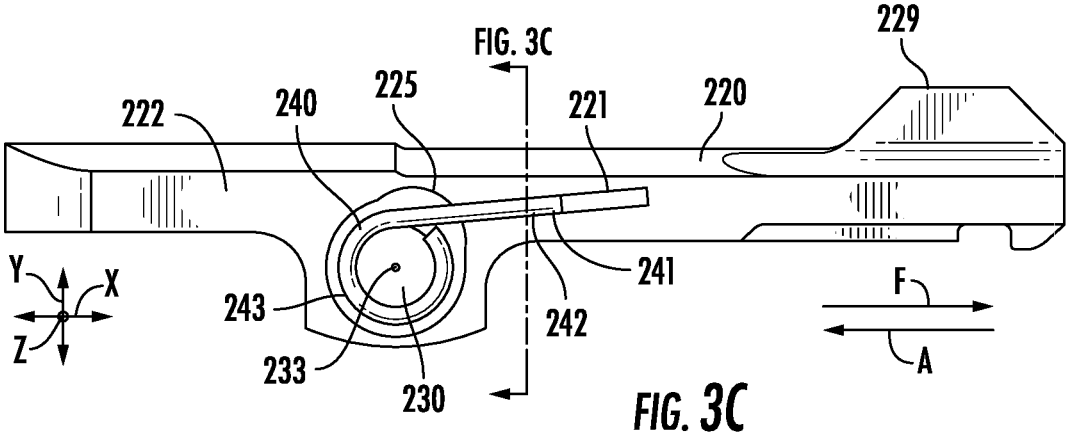

FIG. 3C provides a side view of the extractor and the retainer of FIG. 3A, in accordance with an example embodiment.

Figure 3D:
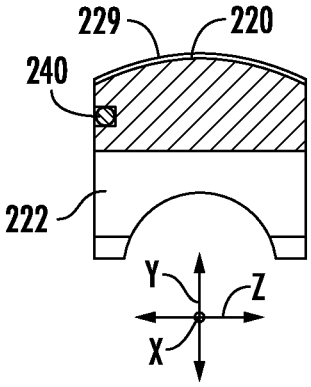

FIG. 3D provides a cross-sectional side view of the extractor and the retainer of FIG. 3A, in accordance with an example embodiment.

Figure 3E:
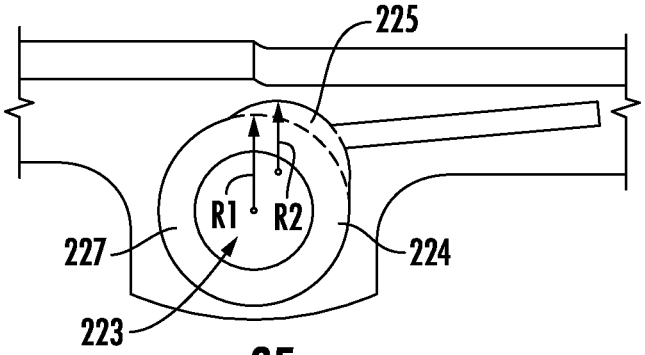

FIG. 3E provides a side view of a portion of the extractor of FIG. 3A, in accordance with an example embodiment.

Figure 4A:
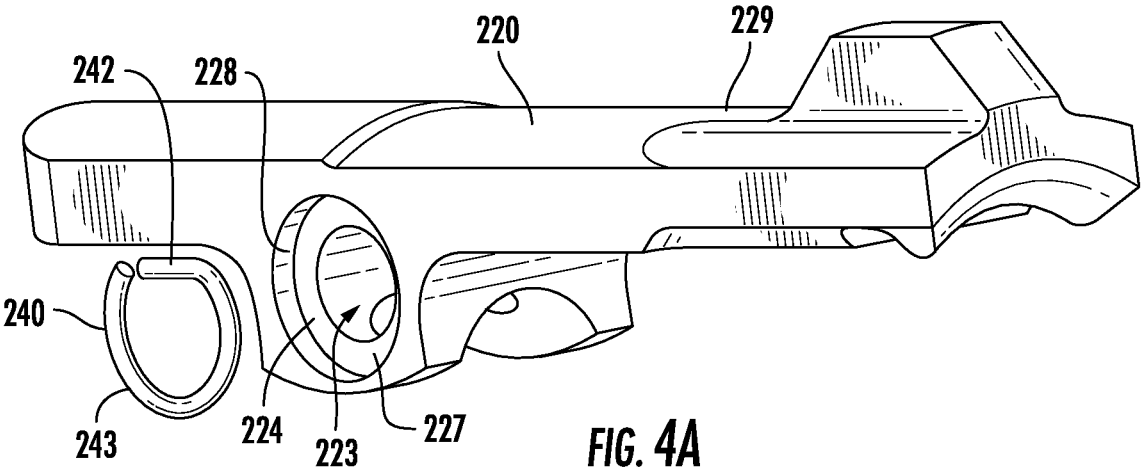

FIG. 4A provides an exploded view of an extractor and a retainer, in accordance with an example embodiment.

Figure 4B:
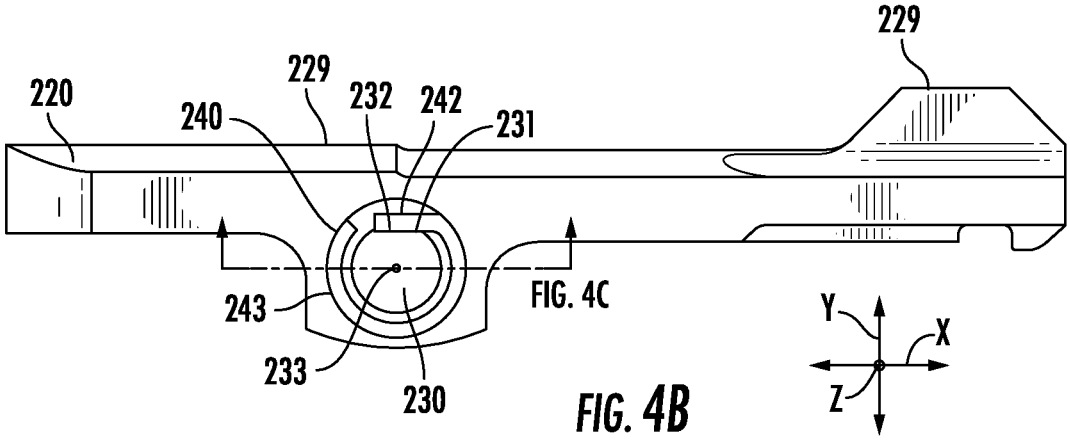

FIG. 4B provides a side view of the extractor and the retainer of FIG. 4A, in accordance with an example embodiment.

Figure 4C:
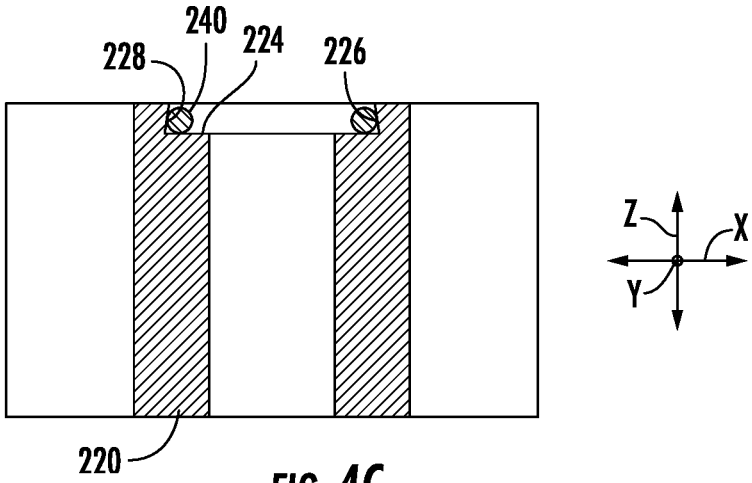

FIG. 4C provides a cross-sectional bottom view of the extractor and the retainer of FIG. 4A, in accordance with an example embodiment.

Figure 5A:
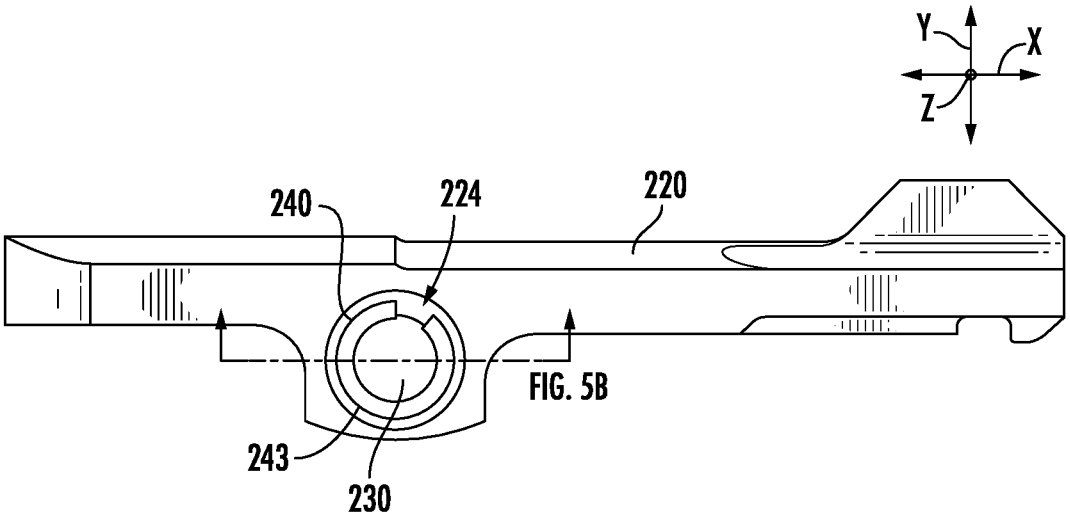

FIG. 5A provides a side view of an extractor and a retainer, in accordance with an example embodiment.

Figure 5B:
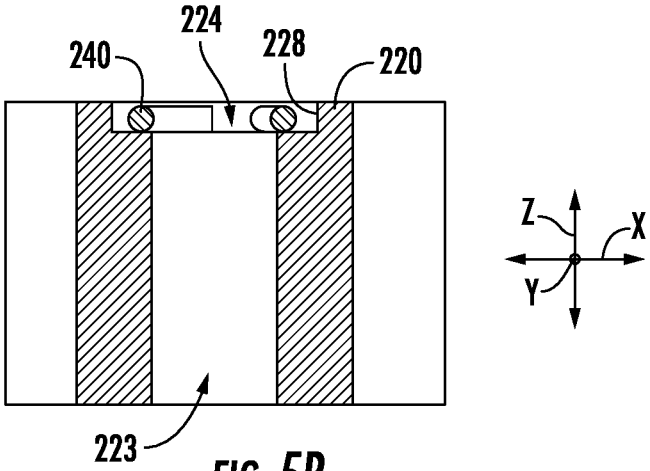

FIG. 5B provides a cross-sectional bottom view of the extractor and the retainer of FIG. 5A, in accordance with an example embodiment.

Figure 6:
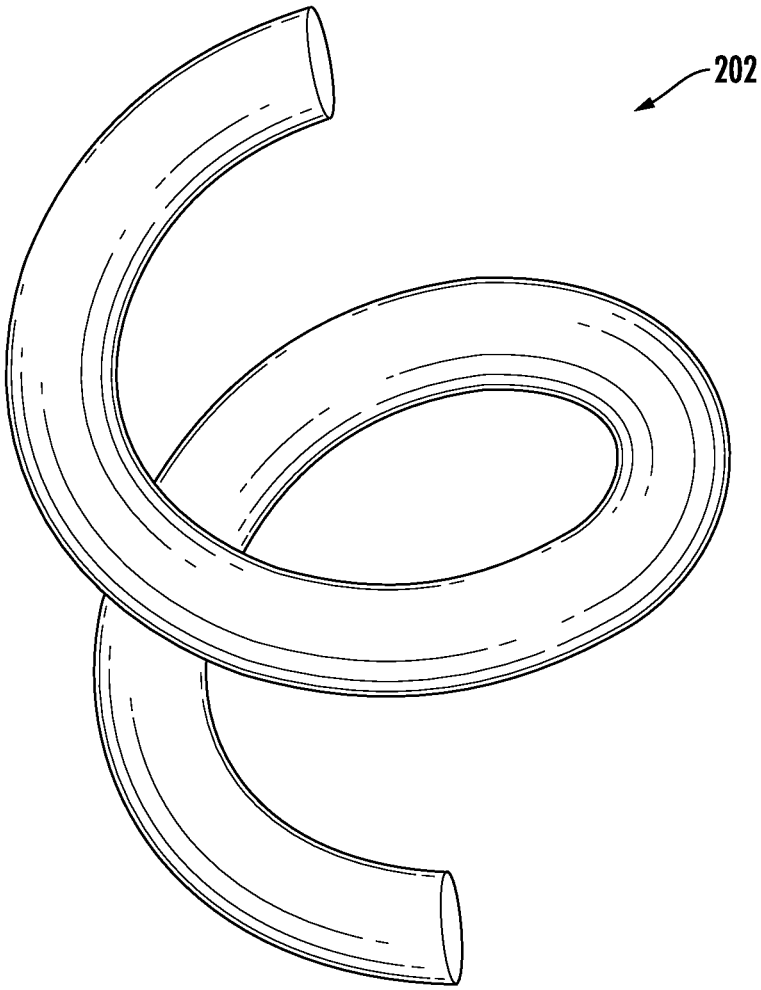

FIG. 6 provides a perspective view of a biasing member, in accordance with an example embodiment.

Figure 7A:
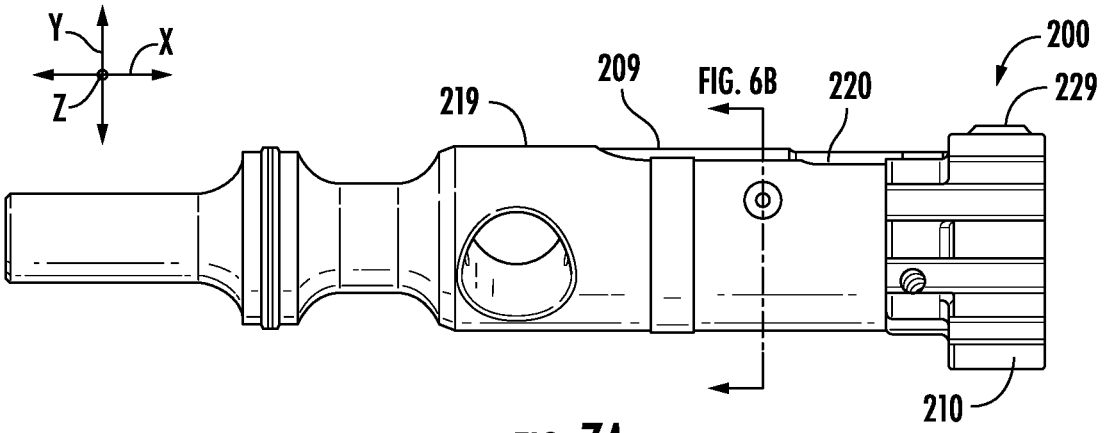

FIG. 7A provides a side view of a bolt assembly, in accordance with an example embodiment.

Figure 7B:
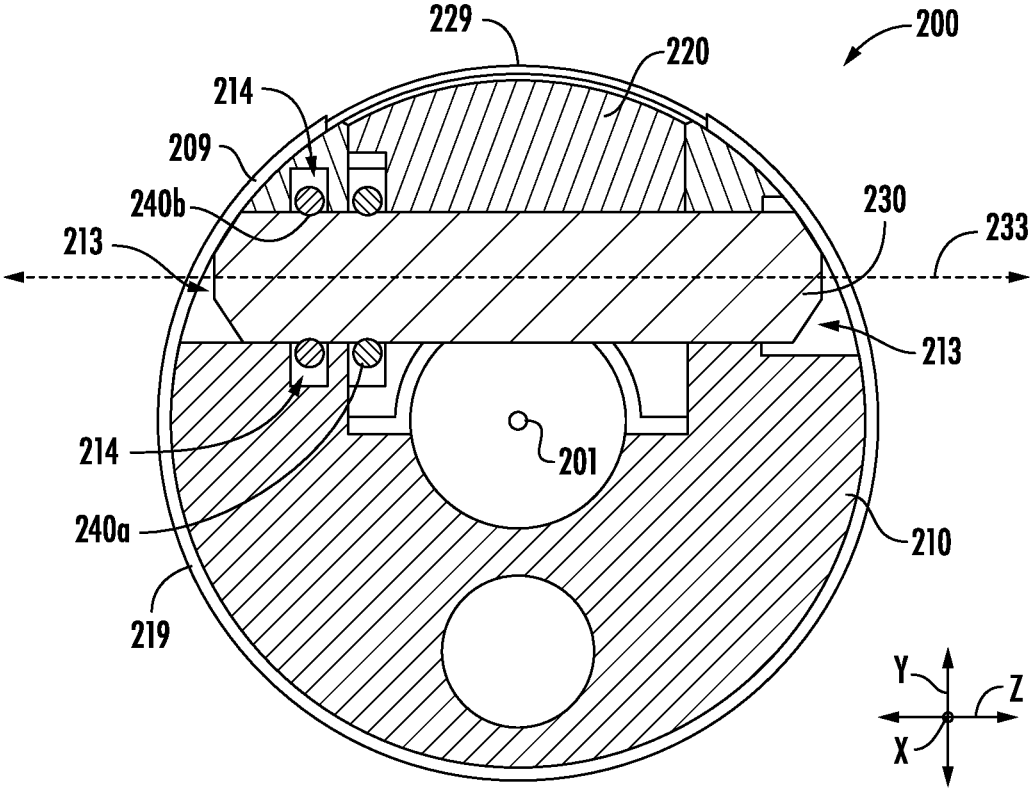

FIG. 7B provides a cross-sectional side view of the bolt assembly of FIG. 7A, in accordance with an example embodiment.

Figure 8A:
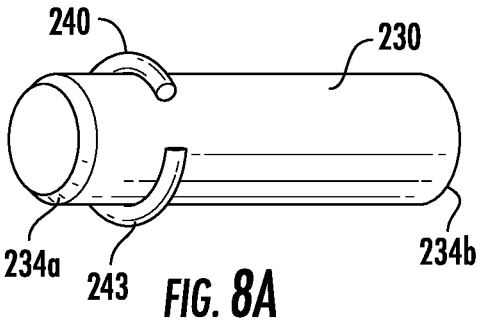

FIG. 8A provides a perspective view of a pin and a retainer, in accordance with an example embodiment.

Figure 8B:
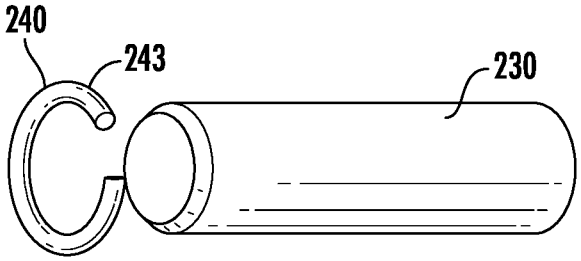

FIG. 8B provides an exploded view of the pin and the retainer of FIG. 8A, in accordance with an example embodiment.

Figure 9A:
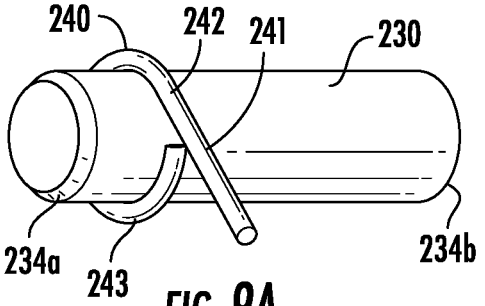

FIG. 9A provides a perspective view of a pin and a retainer, in accordance with an example embodiment.

Figure 9B:
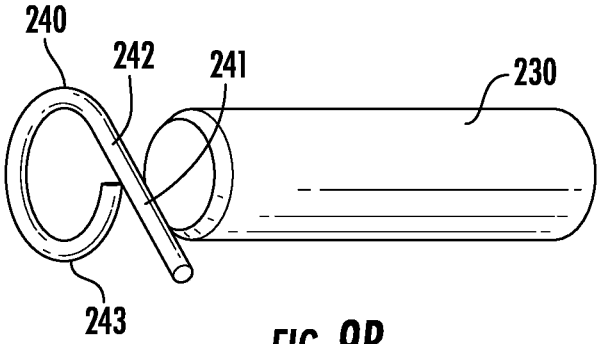

FIG. 9B provides an exploded view of the pin and the retainer of FIG. 9A, in accordance with an example embodiment.

Figure 10A:
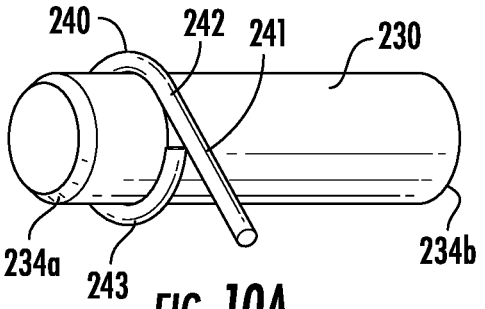

FIG. 10A provides a perspective view of a pin and a retainer, in accordance with an example embodiment.

Figure 10B:
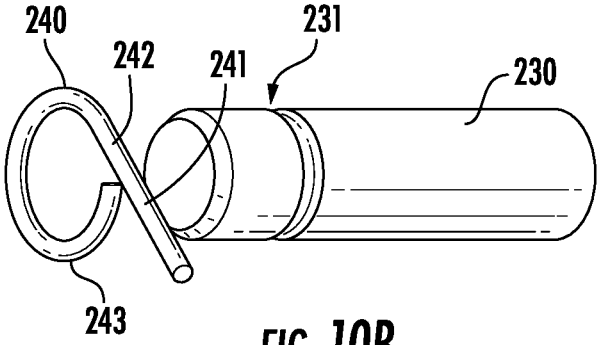

FIG. 10B provides an exploded view of the pin and the retainer of FIG. 10A, in accordance with an example embodiment.

Figure 11A:
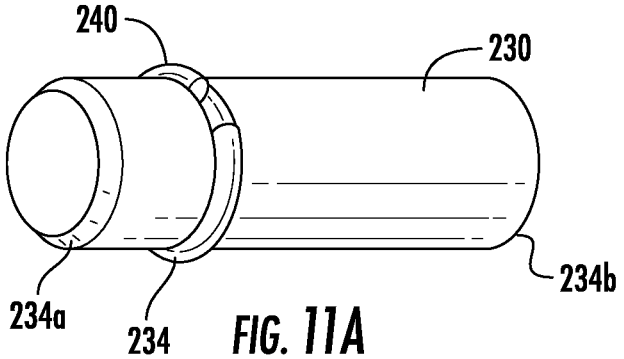

FIG. 11A provides a perspective view of a pin and a retainer, in accordance with an example embodiment.

Figure 11B:
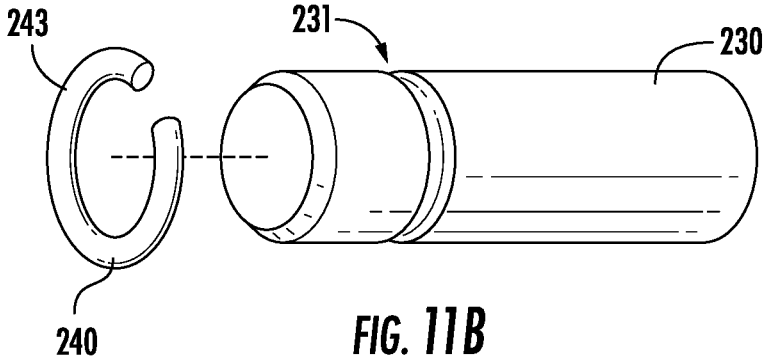

FIG. 11B provides an exploded view of the pin and the retainer of FIG. 11A, in accordance with an example embodiment.

Figure 12:
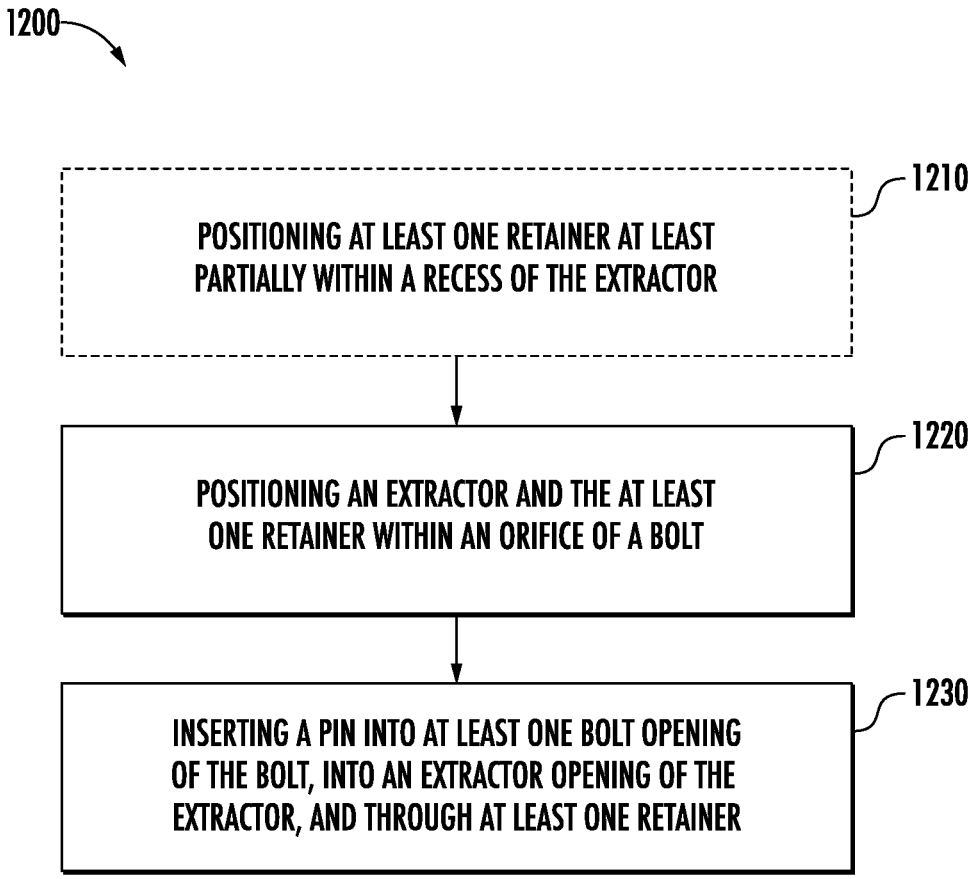

FIG. 12 provides a flowchart of a method, in accordance with an example embodiment.

DETAILED DESCRIPTION

One or more embodiments are now more fully described with reference to the accompanying drawings, wherein like reference numerals are used to refer to like elements throughout and in which some, but not all embodiments of the inventions are shown. In the following description, for purposes of explanation, numerous specific details are set forth in order to provide a thorough understanding of the various embodiments. It is evident, however, that the various embodiments may be practiced without these specific details. It should be understood that some, but not all embodiments are shown and described herein. Indeed, the embodiments may be embodied in many different forms, and accordingly this disclosure should not be construed as limited to the embodiments set forth herein. Rather, these embodiments are provided so that this disclosure will satisfy applicable legal requirements.

As used herein, the term "exemplary" means serving as an example, instance, or illustration. Any aspect or design described herein as "exemplary" is not necessarily to be construed as preferred or advantageous over other aspects or designs. Rather, use of the word exemplary is intended to present concepts in a concrete fashion. In addition, while a particular feature may be disclosed with respect to only one of several implementations, such feature may be combined with one or more other features of the other implementations as may be desired and advantageous for any given or particular application. Furthermore, to the extent that the terms "includes" and "including" and variants thereof are used in either the detailed description or the claims, these terms are intended to be inclusive in a manner similar to the term "comprising."

As used herein, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As used herein, the terms "coupled," "fixed," "attached to," and the like refer to both direct coupling, fixing, or attaching, as well as indirect coupling, fixing, or attaching through one or more intermediate components or features, unless otherwise specified herein.

As used herein, the term "positioned directly on" refers to a first component being positioned on a second component such that they make contact. As used herein, the term "positioned away from" refers to a first component being away from a second component such that they do not make contact. As used herein, the term "positioned directly between" refers to a first component being positioned between a second component and a third component such that the first component makes contact with both the second component and the third component. In contrast, a first component that is "positioned between" a second component and a third component may or may not have contact with the second component and the third component. Additionally, a first component that is "positioned between" a second component and a third component is positioned such that there may be other intervening components between the second component and the third component other than the first component.

As used herein, the term "at least partially" refers to partially or fully. As used herein, terms of approximation, such as "approximately," "substantially," or "about," refer to being within manufacturing or engineering tolerances. For example, terms of approximation may refer to being withing a five percent margin of error.

Referring now to FIG. 1, a cross-sectional view of a firearm 100 is provided, in accordance with an example embodiment. The firearm 100 may define a longitudinal direction X, a vertical direction Y that is orthogonal to the longitudinal direction X, and a lateral direction Z that is orthogonal to the longitudinal direction X and the vertical direction Y. The firearm 100 may define a forward direction F and an aft direction A that extend in the longitudinal direction X. The firearm 100 may define an upward direction U and a downward direction D that extend in the vertical direction Y.

The firearm 100 may be configured as a rifle (e.g., a semi-automatic or automatic rifle). Various embodiments of the firearm 100 discussed herein may include any firearm 100 that includes a bolt assembly for a gas or piston operated rotating bolt system. Various embodiments of the firearm 100 may include, but are not limited to, rifles, pistols, machine guns, sub-machine guns, and semi-automatic shotguns. For example, some embodiments of the firearm 100 may be an M16 platform rifle, AR-15 platform rifle, AR-10 platform rifle, or other similar rifle.

The firearm 100 may include an upper receiver 130 and a barrel 110 that is coupled to the upper receiver 130. The barrel 110 may be configured to allow a projectile 13, such as a bullet or a slug, to travel through it when the firearm 100 is fired. The firearm 100 may include a lower receiver 140 that is coupled to the upper receiver 130. For example, the lower receiver 140 may be coupled to the upper receiver 130 and positioned downward from the upper receiver 130. The firearm 100 may include a magazine 120 that one or more cartridges 11 may be positioned within. Each cartridge 11 may include the projectile 13, propellant (e.g., gunpowder or cordite), primer to ignite the propellant, and a casing 15. The primer may ignite the propellent by, for example, an electronic ignition system or a chemical reaction system. The firearm 100 may include a trigger group 150 that is housed, at least partially, within the lower receiver 140. The trigger group 150 may be configured to initiate the firing of the firearm 100, which may cause the projectile 13 to travel through the barrel 110 that is coupled to the upper receiver 130.

The firearm 100 may include a bolt carrier group 160 that is positioned at least partially within the upper receiver 130. The bolt carrier group 160 may include a bolt carrier, a cam pin, a firing pin, a gas key, one or more gas key screws, a retaining spring, and a bolt assembly 200. The bolt assembly 200 can be configured to move at least in the forward direction F and aft direction A to facilitate removing spent casings of previously fired cartridges from a chamber 112 of the barrel 110 and load another cartridge 11 to be fired into the chamber 112.

Referring now to FIGS. 2A-2C, views of a bolt assembly 200 are provided, in accordance with an example embodiment. The bolt assembly 200 may define a bolt assembly axis 201 that extends in the longitudinal direction X. The bolt assembly 200 may include a bolt 210 and an extractor 220. The bolt 210 may have a bolt exterior surface 219 and the extractor 220 may have an extractor exterior surface 229. Portions of the extractor exterior surface 229 and the bolt exterior surface 219 collectively define an exterior surface 209 of the bolt assembly 200. As used herein, the term "exterior surface" refers to an outermost boundary of the component relative to a center axis 201 of the component.

The bolt 210 may define an orifice 211 that the extractor 220 may be at least partially positioned within. The shape of the orifice 211 may substantially correspond to a shape of the extractor 220. For example, the side portions 222 of the extractor 220 may have a shape that corresponds to a shape of the inner walls 212 of the bolt 210. The bolt 210 may define at least one bolt opening 213 and the extractor 220 may define at least one extractor opening 223. The bolt assembly 200 may include a pin 230 that may be positioned within the at least one bolt opening 213 and the at least one extractor opening 223. The extractor 220 may be configured to pivot relative to the bolt 210 when, for example, chambering a new cartridge 11 into the chamber 112 of the firearm 100. In various examples, the extractor 220 is configured to pivot on a pin axis 233 that is defined by the pin 230 and extends in the lateral direction Z. The bolt assembly 200 may include a biasing member 202 (e.g., a spring) that is positioned aft of the pin 230 and may be configured to bias an aft end of the extractor 220 at least in the upward direction U and a forward end of the extractor 220 at least in the downward direction D. Referring briefly to FIG. 6, the biasing member 202 may have a helix shape or any other shape that can bias the extractor 220. The bolt assembly 200 may include a damper 203 that may be positioned proximate to or within the biasing member 202.

The bolt assembly 200 may include at least one retainer 240. Each retainer 240 may be configured as a means for retaining the pin 230 within the bolt assembly 200 (e.g., within an exterior surface 209 of the bolt assembly 200). Each retainer 240 may prevent the pin 230 from rubbing on an interior surface of the upper receiver 130 during cycling or may prevent the pin 230 from falling out of the bolt assembly 200. For example, in various embodiments, each retainer 240 may be configured to prevent a substantial movement of the pin 230 in the lateral direction Z. As used herein, the term "substantial movement" refers to movement other than slight vibrational movement. The at least one retainer 240 may comprise a metallic material, such as an aluminum alloy or steel, or a non-metallic material, such as a plastic, such as polyether ether ketone, such as unfilled polyether ether ketone, glass-filled polyether ether ketone, carbon-filled polyether ether ketone, or bearing grade polyether ether ketone. Each retainer 240 may have a cross-sectional shape that is circular or non-circular.

Providing a retainer 240 to prevent a substantial movement of the pin 230 in the lateral direction Z has various benefits. For example, when the bolt assembly 200 is not being operated and is removed from the firearm 100 and the bolt carrier group 160, the pin 230 may be retained in place by the retainer 240. However, if a retainer 240 is not provided, only the force created by the one or more biasing member 202 would prevent the movement of the pin 230 in the lateral direction Z. If the one or more biasing member 202 has suffered a failure or has fatigued beyond the point of producing the required force to retain the pin 230 in place, the pin 230 may undesirably fall free from the opening of the bolt 210 and the extractor 220, if a retainer 240 is not provided. If the pin 230 is lost or damaged after leaving the bolt assembly 200, the bolt assembly 200 and, subsequently, the firearm 100, may be rendered unreliable or unusable.

Another benefit of providing a retainer 240 to prevent a substantial movement of the pin 230 in the lateral direction Z is that it may allow the axial stroke length of the bolt assembly 200 to be increased such that the bolt 210 of the bolt assembly 200 could extend beyond the inner walls 212 of the containment bore of the bolt carrier of the bolt carrier group 160. For example, if a retainer 240 is not used to maintain the lateral position of the pin 230, the pin 230 may no longer be retained in place by the force exerted by the one or more biasing member 202 when the extractor 220 is pivoted outward. As such, when a retainer 240 is not used and the extractor 220 is pivoted outward, the extractor 220 pin 230 may only be held in place by the inner walls 212 of the containment bore of the bolt carrier during certain stages of operation. Because the pin 230 may only be held in place by the inner walls 212 of the containment bore of the bolt carrier during operation when a retainer 240 is not used, there may be design limitations that limit the axial stroke length of the bolt 210 within the bolt carrier group 160 if a retainer 240 is not provided. More specifically, the design of a bolt assembly 200 without a retainer 240 to retain the pin 230 may require the axial stroke length of the bolt assembly 200 to be such that the pin 230 may not extend beyond the inner walls 212 of the containment bore of the bolt carrier because the pin 230 may fall from the bolt assembly 200, rendering the firearm 100 unusable. When a retainer 240 is provided, the axial stroke length of the bolt assembly 200 can be increased such that the pin 230 within the bolt assembly 200 can extend past the containment bore of the bolt carrier.

In various embodiments, and as will be discussed further, at least one retainer 240 may be configured to rotate the pin 230 on the pin axis 233 and/or be configured to rotate around the pin 230. In various embodiments, at least one retainer 240 may be configured as a circlip. For example, the at least one retainer 240 may be manufactured from a semi-flexible material, such as a metal, and may not have a completely enclosed shape so that the at least one retainer 240 may be flexed (e.g., expanding its internal circumference) to allow the pin 230 to extend through the at least one retainer 240. At least one retainer 240 may extend at least partially in a circumferential direction defined by the pin axis 233. For example, at least one retainer 240 may be configured to have an interference fit onto the pin 230 such that the at least one retainer 240 must be elastically deformed in order to install on or remove from the pin 230.

In various examples, at least one retainer 240 may be positioned inward relative to the exterior surface 209 of the bolt assembly 200. For example, at least one retainer 240 may be positioned between the extractor 220 and the bolt 210 and/or within a channel 214 (FIG. 7B) of the bolt 210. In various examples, at least one retainer 240 is positioned inward relative to the bolt exterior surface 219 of the bolt 210 in a radial direction defined by the bolt assembly axis 201. In some embodiments, the at least one retainer 240 is positioned inward relative to a portion of the bolt exterior surface 219 on a same cross-sectional plane defined perpendicular to the axis 201. In some embodiments, the at least one retainer 240 may be positioned between a portion of the extractor 220 and a portion of the bolt 210.

Referring now to FIG. 3A through FIG. 3E, views of an extractor 220, a retainer 240, and a pin 230 are provided, in accordance with an example embodiment. The extractor 220 may include a recessed portion 224 that is configured to allow at least a portion of a retainer 240 to be positioned within the recessed portion 224. The recessed portion 224 may be a portion of the extractor 220 that is recessed relative to the extractor exterior surface 229. For example, the recessed portion 224 may be a portion of the extractor 220 that is recessed inward along the lateral direction Z and relative to a side portion 222 of the extractor exterior surface 229 that may extend generally along a plane defined by the longitudinal direction X and the vertical direction Y.

The recessed portion 224 may generally have an annular shape that extends partially around the at least one extractor opening 223 or fully around the at least one extractor opening 223. In various examples, and with reference to FIG. 3E, the recessed portion 224 has an annular portion 227 that has an annular shape and a portion that deviates from the annular shape and defines a bump feature 225. The bump feature 225 may define any shape and can have at least one straight side, at least one curved side, or a combination of at least one straight side and at least one curved side. In various examples, and as depicted in FIG. 3E, the bump feature 225 may define a crescent shape and/or a lune shape. The annular portion 227 may have a curved outer periphery that defines a first radius R1 of curvature and the bump feature 225 may have a curved outer periphery that defines a second radius R2 of curvature. The first radius R1 of the annular portion 227 may be greater than the second radius R2 of the bump feature 225. The bump feature 225 may allow a retainer 240 that is positioned at least partially within the recessed portion 224 to flex outward relative to a pin 230 that is being inserted through the at least one retainer 240. Also, the bump feature 225 may prevent a permanent bend (e.g., plastic deformation) in the at least one retainer 240 caused by the at least one retainer 240 expanding to allow the pin 230 to extend through the at least one retainer 240.

In some embodiments, the recessed portion 224 may define a primary shape that has any shape. For example, the recessed portion 224 may define a primary shape that is non-annular. In various examples, the recessed portion 224 may define an irregular polygonal shape or a regular polygonal shape, such as a square, rectangle, triangle, pentagon, etc. shape. The recessed portion 224 may define a non-polygonal shape, such as an oval shape. The primary shape of the recessed portion 224 can have at least one straight side, at least one curved side, or a combination of at least one straight side and at least one curved side.

A portion of the recessed portion 224 may deviate from the primary shape, which may define the bump feature 225. The bump feature 225 may extend from the primary shape of the recessed portion 224 on at least one of the straight sides or at least one of the curved sides. The bump feature 225 may extend from the primary shape of the recessed portion 224 on at least two of the sides, such as at least two of the straight sides, at least two of the curved sides, or at least one of the straight sides and at least one of the curved sides. In various examples, the bump feature 225 may extend from the primary shape of the recessed portion 224 on all sides. The bump feature 225 can have any size relative to the primary shape of the recessed portion 224.

In various examples, the extractor 220 has a slot 221. The slot 221 may extend in a linear direction from the recessed portion 224 or the bump feature 225 of the recessed portion 224. The slot 221 may extend generally in the forward direction F from the recessed portion 224 or the bump feature 225. For example, the slot 221 may extend generally in the forward direction F and at a downward or an upward angle that is within 90 degrees, such as within 60 degrees, such as within 30 degrees, such as within 20 degrees of the longitudinal direction X (e.g., in each instance as measured in a neutral position of the extractor 220 with the biasing member 202, such as a spring, in its most extended position). In various examples, the slot 221 may extend generally in the aft direction A and at a downward or an upward angle that is within 90 degrees, such as within 60 degrees, such as within 30 degrees, such as within 20 degrees of the longitudinal direction X. In various examples, the slot 221 may extend at a 90 degree angle relative to the longitudinal direction X, either upward or downward. In various examples, the slot 221 may extend parallel to the longitudinal direction X, either in the forward direction F or in the aft direction A. As will be discussed further, the slot 221 may be configured to allow an arm 241 of a retainer 240 to be positioned at least partially within. The arm 241 that may be positioned at least partially within the slot 221 and may also extend at an angle relative to the longitudinal direction. For example, the arm 241 may extend at the same angle as the slot 221 that it is positioned within.

Referring still to FIGS. 3A-3E, the at least one retainer 240 may include a curved portion 243 that extends circumferentially. For example, the curved portion 243 of the at least one retainer 240 may be configured to extend circumferentially at least partially around a pin 230 that may be extended through the curved portion 243. The curved portion 243 of the at least one retainer 240 may be configured to fit at least partially within the annular portion 227 of the recessed portion 224. The at least one retainer 240 may include a straight portion 242 that extends linearly. In various examples, the straight portion 242 comprises an arm 241 that is configured to fit within the slot 221 of the extractor 220. The at least one retainer 240 may be generally P-shaped.

As previously discussed, the extractor 220 may pivot on the pin axis 233 when, for example, chambering a new cartridge 11 into the chamber 112 of the firearm 100. When the extractor 220 pivots on the pin axis 233, the arm 241 that is at least partially within the slot 221 may also pivot. When the extractor 220 and arm 241 pivot counter-clockwise, as viewed in the orientation of FIG. 3C, the curved portion 243 of the at least one retainer 240 may enlarge and loosen its grip on the pin 230 (e.g., similar to a one-way clutch). As such, the curved portion 243 may rotate counter-clockwise relative to the pin 230. When the extractor 220 and arm 241 subsequently pivot clockwise, the curved portion 243 of the at least one retainer 240 may constrict around the pin 230 and may rotate the pin 230 clockwise. Allowing the curved portion 243 of the at least one retainer 240 to rotate relative to the pin 230 and/or the pin 230 to rotate may increase the durability of the pin 230, the extractor 220, and/or the bolt 210. An additional technical benefit of the retainer 240 and extractor 220 shown in FIGS. 3A-3E is that assembly may be improved by allowing the retainer 240 to be placed in the recessed portion 224 prior to inserting the pin 230; the recessed portion 224, including the bump feature 225, may allow the retainer 240 to expand during insertion of the pin 230. In some such embodiments, the pin 230 may comprise a groove 231 into which the retainer 240 seats when the pin 230 is fully inserted, such that the retainer 240 may constrict into the groove 231 for an interference fit once the pin 230 is inserted.

Referring now to FIG. 4A through FIG. 4C, views of an extractor 220, a retainer 240, and a pin 230 are provided, in accordance with an example embodiment. In various examples, the recessed portion 224 has an annular shape. The at least one retainer 240 may be positioned completely within the recessed portion 224. The at least one retainer 240 may generally form a D-shape.

The at least one retainer 240 may include a straight portion 242 that is configured to be positioned directly on the pin 230 such that the straight portion 242 makes contact with the pin 230 when the pin 230 and the at least one retainer 240 are installed within the extractor 220. In various examples, the pin 230 may have a flat portion 232. The flat portion 232 may extend partially down a length of the pin 230 such that the flat portion 232 is a groove 231 on the pin 230 that extends partially around the pin 230. In various examples, the flat portion 232 extends a full length of the pin 230.

The at least one retainer 240 may include a curved portion 243 that is configured to be positioned away from the pin 230 such that the curved portion 243 does not make contact with the pin 230 when the pin 230 and the at least one retainer 240 are installed within the extractor 220. In various examples, the curved portion 243 of the at least one retainer 240 may form an interference fit with a wall 228 of the recessed portion 224. For example, the at least one retainer 240 may be configured to exert a radial force on the wall 228 of the extractor 220 relative to the pin axis 233, which may prevent a circumferential movement of the at least one retainer 240 relative to the extractor 220.

In various examples, and with reference to FIG. 4C, the wall 228 of the recessed portion 224 of the extractor 220 may define a retainment feature 226. For example, the retainment feature 226 may have a cross-sectional dovetail shape. In various examples, the retainment feature 226 may have a cross-sectional T-shape. The retainment feature 226 may prevent a movement of the at least one retainer 240 in the lateral direction Z relative to the extractor 220. In such embodiments, the retainer 240 may compress slightly during insertion into the recessed portion 224. Once compressed, the retainer 240 may then engage the retainment feature 226 to prevent the retainer 240 from separating from the extractor 220 during installation prior to the insertion of the pin 230, or may prevent the retainer 240 and the pin 230 from moving in the lateral direction Z during operation of the firearm 100. In various examples, the at least one retainer 240 and the retainment feature 226 have an interference fit between the two components to prevent the at least one retainer 240 from rotating within the recessed portion 224.

In various examples, the at least one retainer 240 and the retainment feature 226 does not have an interference fit between the two components or does not have a sufficient interference fit to prevent the at least one retainer 240 from rotating within the recessed portion 224. As such, when the extractor 220 pivots on the pin axis 233, the at least one retainer 240 may also pivot on the pin axis 233 because of the interference fit between the extractor 220 and the at least one retainer 240. When the at least one retainer 240 pivots on the pin axis 233, the pin 230 may also pivot on the pin axis 233 because of the engagement of the straight portion 242 of the at least one retainer 240 with the flat portion 232 of the pin 230. Allowing the at least one retainer 240 and the pin 230 to pivot with the extractor 220 may increase the durability of the pin 230, the extractor 220, and/or the bolt 210. Additionally, because a sufficient interference fit between the at least one retainer 240 and the retainment feature 226 is unnecessary in some examples, the tolerances of the at least one retainer 240 and/or the retainment feature 226 may be less stringent, which may decrease manufacturing costs and/or repairability.

Referring now to FIG. 5A through FIG. 5B, views of an extractor 220, a retainer 240, and a pin 230 are provided, in accordance with an example embodiment. In various example, the at least one retainer 240 has a C-shape. For example, the at least one retainer 240 may only include a curved portion 243 and may not include a straight portion 242. The at least one retainer 240 may be configured to constrict around the pin 230 to engage therewith (e.g., via defining a resting, unstretched internal circumference that is less than an external circumference of at least a portion of the pin 230). The recessed portion 224 may be sized such that the at least one retainer 240 does not make contact with the wall 228 of the recessed portion 224. For example, an inner diameter of the wall 228 may be greater than an outer diameter of the at least one retainer 240, and the at least one retainer 240 and the pin 230 may "free float" within the at least one extractor opening 223.

In various examples, when the extractor 220 pivots on the pin axis 233, the pin 230 and the at least one retainer 240 may not pivot in unison with the extractor 220. For example, the at least one retainer 240 may be configured to allow the extractor 220 to pivot relative to the pin 230 and the at least one retainer 240, but prevent the movement of the pin 230 relative to the extractor 220 in the lateral direction Z. In some embodiments, a groove 231 may be used in the pin 230 to permit rotation of the pin 230 and/or extractor 220 while preventing lateral Z-direction movement of the pin 230 and/or extractor 220.

Referring now to FIG. 7A through FIG. 7B, views of a bolt assembly 200 are provided, in accordance with an example embodiment. As previously discussed, at least one retainer 240 may be positioned inward relative to the exterior surface 209 of the bolt assembly 200. For example, at least one retainer 240, such as at least a first retainer 240*a*, may be positioned within a recessed portion 224 of the extractor 220 and/or positioned between the extractor 220 and the bolt 210 along the lateral direction Z.

At least one retainer 240, such as at least a second retainer 240*b*, may be positioned inward relative to the bolt exterior surface 219 of the bolt 210 along a radial direction defined by the bolt assembly axis 201. For example, at least one retainer 240 may be positioned within a channel 214 that is defined by the bolt 210. The channel 214 that is defined by the bolt 210 may extend circumferentially around the pin axis 233, such as circumferentially around a bolt opening 213.

In various examples, such as the embodiment shown in FIG. 7B, the bolt assembly 200 includes two or more retainers 240. For example, a first retainer 240*a* may be associated with the extractor 220, such as positioned at least partially within the recessed portion 224 of the extractor 220, and a second retainer 240*b* may be associated with the bolt 210, such as positioned at least partially within a channel 214 defined by the bolt 210. One or more instances of the various examples of the retainer(s) 240 discussed herein may be used alone or in combination with any other of the various retainer 240 examples. For example, in some embodiments, one or more retainers 240 may be positioned on either side of the extractor 220, and in some embodiments, multiple of the same type of retainer 240 may be used in two or more locations.

In various examples, the second retainer 240*b* may be configured the same as the first retainer 240*a*. For example, both the first retainer 240*a* and the second retainer 240*b* may be generally P-shaped, as described in reference to FIGS. 3A-3E, both may be generally D-shaped, as described in reference to FIGS. 4A-C, or both may be generally C-shaped, as described in reference to FIGS. 5A-5B. In various examples, the second retainer 240*b* may be configured differently than the first retainer 240*a*. For example, one of the first retainer 240*a* or the second retainer 240*b* may be generally D-shaped or C-shaped and the other of the first retainer 240*a* or the second retainer 240*b* may be generally P-shaped. In various examples, one of the first retainer 240*a* or the second retainer 240*b* is C-shaped whereas the other of the first retainer 240*a* or the second retainer 240*b* is generally D-shaped. Both the first retainer 240*a* and the second retainer 240*b* may be removably coupled to the pin 230.

Referring now to FIGS. 8A-8B, views of a pin 230 and a retainer 240 are provided, in accordance with various example embodiments. The pin 230 may have a cylindrical shape that defines a first edge 234*a* and a second edge 234*b*. At least one of the edges 234*a, b* may be a sharp (e.g., right-angle) edge, a fillet edge, or a chamfered edge. Providing at least one edge that has a fillet edge or a chamfered edge may reduce a force required to insert the pin 230 through the at least one retainer 240. As will be discussed further, in various examples, the at least one retainer 240 may be positioned within the recessed portion 224 of the extractor 220, which is subsequently positioned within the orifice 211 of the bolt 210, prior to the pin 230 being positioned within the bolt assembly 200. In some embodiments, the at least one retainer 240 may be flush with an outermost surface of the extractor 220 (e.g., without a recessed portion 224). As such, in various examples, to install the pin 230 within the bolt assembly 200 after the at least one retainer 240 is positioned within the extractor 220, the pin 230 must be forced through at least the curved portion 243 of the at least one retainer 240, which may flex and allow the pin 230 to extend therethrough. The fillet or chamfered edges may act like a wedge, which may act like a force-multiplying device. Therefore, providing at least one fillet or chamfered edge may reduce the force required to insert the pin 230 through the at least one retainer 240.

In various examples, the pin 230 may have a smooth, cylindrical surface that extends completely from the first edge 234*a* to the second edge 234*b*, as depicted in FIGS. 8A-9B. In various examples, and with reference to FIGS. 10A-11B, which provides views of a pin 230 and a retainer 240 in accordance with various example embodiments, the pin 230 may include at least one groove 231. The at least one groove 231 may extend at least partially around the pin 230 in a circumferential direction defined by the pin 230, as depicted in FIGS. 10A-11B. The groove 231 may be configured to allow the retainer 240 to be positioned at least partially within the groove 231. In various examples, the groove 231 may allow for a clearance fit with the retainer 240. For example, a width of the groove 231 may be between one mil (i.e., one-thousandth of an inch) and five mil (i.e., five-thousandths of an inch) of a thickness of the portion of the retainer 240 to be positioned within the groove 231 to provide a clearance fit. In various examples, the groove 231 may be sized such that the retainer 240 fits tightly within or is constricted by the pin 230 when the retainer 240 is positioned at least partially within the groove 231. For example, a width of the groove 231 may be within one mil (i.e., one-thousandth of an inch) of a thickness of the portion of the retainer 240 to be positioned within the groove 231 to provide a tight fit. A width of the groove 231 may be less than a thickness of the portion of the retainer 240 to be positioned within the groove 231 to provide a constricting or interference fit. Providing a constricting or interference fit between the groove 231 and the retainer 240 may promote the rotation of the pin 230 with the retainer 240, which may increase the durability of the pin 230.

Referring now to FIG. 12, a flowchart of a method 1200 of assembling a bolt assembly 200 is provided, in accordance with an example embodiment. The method 1200 may include a step 1210 of positioning at least one retainer 240 at least partially within a recess of the extractor 220. For example, and as previously discussed, a retainer 240 may be positioned within the recess of the extractor 220 or within the recess and the slot 221 of the extractor 220.

The method 1200 may include a step 1220 of positioning an extractor 220 and the at least one retainer 240 within an orifice 211 (FIG. 2) of a bolt 210. When the method 1200 includes the step 1210 of positioning the at least one retainer 240 at least partially within the recess of the extractor 220, the extractor 220 and the retainer 240 may be positioned within the orifice 211 of the bolt 210 together. When the method does not include the step 1210 of positioning the at least one retainer 240 at least partially within the recess of the extractor 220, the retainer 240 may be positioned within the orifice 211 and then subsequently positioned within the channel 214 (FIG. 7B) of the bolt 210. Once the retainer 240 is positioned within the channel 214, the extractor 220 may be positioned within the orifice 211 of the bolt 210. As such, the extractor 220 and the retainer 240 may be positioned within the orifice 211 sequentially.

The method 1200 may include a step 1230 of inserting a pin 230 into at least one bolt opening 213 of the bolt 210, into an extractor opening 223 of the extractor 220, and through the at least one retainer 240. For example, the pin 230 may be inserted into one of the at least one bolt opening 213, and then through either the at least one extractor opening 223 and then through the at least one retainer 240, or through the at least one retainer 240 and then through the at least one extractor opening 223. Once the pin 230 is inserted into the one of the at least one bolt opening 213, the at least one extractor opening 223, and through the at least one retainer 240, the pin 230 may be inserted into another one of the at least one bolt opening 213.

In various examples, the method 1200 may include a step of inserting at least one retainer 240 within a groove 231 of the pin 230 and then subsequently inserting the pin 230 and the retainer 240 through one of the at least one bolt opening 213, through the at least one extractor opening 223, and through another one of the at least one bolt opening 213.

As will be appreciated, the bolt assembly 200 of the present disclosure has various benefits. For example, and unlike existing bolt assemblies, the pin 230 may be retained within the bolt assembly 200 by the retainer 240 in the event that the biasing member 202 has suffered a failure or has fatigued beyond the point of producing the required force to retain the extractor pin in place. As such, when the bolt assembly 200 is removed from the firearm and the bolt carrier group 160, the position of the pin 230 within the bolt assembly 200 may be maintained even if the biasing member 202 no longer exerts a sufficient amount of force to retain the pin 230.

Additionally, and unlike existing bolt assemblies, the bolt carrier group 160 and firearm may retain the pin 230 within the bolt assembly 200 when the bolt assembly 200 extends beyond the inner walls of the containment bore of the bolt carrier. As such, design limitations that require the axial stroke length of the bolt assembly to not extend beyond the inner walls of the containment bore of the bolt carrier may not be necessary.

CONCLUSION

The above descriptions of various embodiments of the subject disclosure and corresponding figures and what is described in the Abstract, are described herein for illustrative purposes, and are not intended to be exhaustive or to limit the disclosed embodiments to the precise forms disclosed. It is to be understood that one of ordinary skill in the art may recognize that other embodiments having modifications, permutations, combinations, and additions may be implemented for performing the same, similar, alternative, or substitute functions of the disclosed subject matter, and are therefore considered within the scope of this disclosure. Therefore, the disclosed subject matter should not be limited to any single embodiment described herein, but rather should be construed in breadth and scope in accordance with the appended claims below. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A bolt assembly that defines a longitudinal direction and a radial direction that is orthogonal to the longitudinal direction, the bolt assembly comprising:

a bolt defining at least one bolt opening;

an extractor that is configured to pivot relative to the bolt, the extractor defining at least one extractor opening;

a pin positioned within the at least one bolt opening and the at least one extractor opening; and a retainer that defines a curved portion that extends at least partially around the pin, wherein the retainer is positioned inward relative to an exterior surface of the bolt assembly, wherein the retainer is removably coupled to the pin.

2. The bolt assembly of claim 1, wherein the retainer comprises a circlip.

3. The bolt assembly of claim 1, wherein the retainer has a straight portion.

4. The bolt assembly of claim 3, wherein the curved portion is positioned away from the pin, and wherein the straight portion is positioned directly on the pin.

5. The bolt assembly of claim 3, wherein the extractor comprises a slot, and wherein the straight portion of the retainer is an arm that is positioned at least partially within the slot of the extractor.

6. The bolt assembly of claim 5, wherein the arm extends thirty degrees or less relative to the longitudinal direction.

7. The bolt assembly of claim 1, wherein the retainer is configured to exert a radial force on the extractor relative to an axis defined by the pin.

8. The bolt assembly of claim 1, wherein the pin defines a groove, wherein the retainer is at least partially positioned within the groove.

9. The bolt assembly of claim 1, wherein the extractor defines a recessed portion, wherein the retainer is at least partially positioned within the recessed portion.

10. The bolt assembly of claim 9, wherein the recessed portion defines an annular portion that has an annular shape and a bump feature that deviates from the annular shape.

11. The bolt assembly of claim 9, wherein the recessed portion of the extractor defines a retainment feature configured to engage the retainer.

12. The bolt assembly of claim 11, wherein the retainment feature has a cross-sectional dovetail shape or T-shape.

13. The bolt assembly of claim 1, wherein the bolt defines a channel that extends at least partially around the at least one bolt opening, wherein the retainer is at least partially positioned within the channel.

14. A firearm comprising the bolt assembly of claim 1.

15. A bolt assembly that defines a longitudinal direction and a radial direction that is orthogonal to the longitudinal direction, the bolt assembly comprising:

a bolt defining at least one bolt opening;

an extractor that is configured to pivot relative to the bolt, the extractor defining at least one extractor opening;

a pin positioned within the at least one bolt opening and the at least one extractor opening;

a first retainer that is positioned inward relative to an exterior surface of the bolt assembly, wherein the first retainer is removably coupled to the pin; and a second retainer that is removably coupled to the pin.

16. A method of assembling a bolt assembly, the method comprising:

positioning an extractor and a retainer within an orifice of a bolt such that an entirety of the retainer is positioned between the extractor and the bolt; and inserting a pin into at least one bolt opening of the bolt, into at least one extractor opening of the extractor, and through the retainer.

17. The method of claim 16, further comprising positioning the retainer within a recessed portion of the extractor prior to positioning the extractor and the retainer within the orifice of the bolt.

18. The method of claim 17, further comprising positioning an arm of the retainer within a slot of the extractor.

19. The method of claim 16, further comprising:

positioning a second retainer within a channel of the bolt; and inserting the pin through the second retainer.

20. A bolt assembly comprising:

a bolt defining at least one bolt opening;

an extractor that is configured to pivot relative to the bolt, the extractor defining at least one extractor opening;

a pin positioned within the at least one bolt opening and the at least one extractor opening; and a means for retaining the pin within the bolt assembly, wherein the means for retaining the pin defines a curved portion that extends at least partially around the pin and is positioned inward relative to an exterior surface of the bolt assembly.

* * * * *